US009194662B1

(12) United States Patent
Poulsen

(10) Patent No.: US 9,194,662 B1
(45) Date of Patent: Nov. 24, 2015

(54) ARTICLE FOR DISPERSING ENERGY OF A BLAST OR IMPACT

(71) Applicant: Peter D. Poulsen, Grants Pass, OR (US)
(72) Inventor: Peter D. Poulsen, Grants Pass, OR (US)

( * ) Notice: Subject to any disclaimer, the term of this patent is extended or adjusted under 35 U.S.C. 154(b) by 489 days.

(21) Appl. No.: 13/842,991
(22) Filed: Mar. 15, 2013
(51) Int. Cl.
*B32B 27/04* (2006.01)
*F41H 5/02* (2006.01)
(52) U.S. Cl.
CPC ..... *F41H 5/02* (2013.01)
(58) Field of Classification Search
USPC ..... 442/135; 428/911; 89/36.02
See application file for complete search history.

(56) References Cited

U.S. PATENT DOCUMENTS 3,969,563 A * 7/1976 Hollis, Sr. ..... B32B 3/28 220/62.11
4,921,751 A * 5/1990 Wakahara ..... B32B 7/12 139/420 A
5,711,960 A * 1/1998 Shikinami ..... A61F 2/0063 424/425
6,745,662 B2 * 6/2004 Ford ..... F41H 5/04 428/116
7,642,206 B1 * 1/2010 Bhatnagar ..... B32B 5/26 428/102
7,825,048 B2 * 11/2010 Wang ..... A43B 7/32 2/2.5
7,833,627 B1 * 11/2010 Ferrando ..... F41H 5/0442 428/416
7,958,812 B2 * 6/2011 Wang ..... F41H 5/0492 2/2.5
7,997,181 B1 * 8/2011 Tunis ..... F41H 5/0435 89/36.02
8,171,569 B2 * 5/2012 Chiou ..... A41D 31/0061 2/2.5
8,236,711 B1 * 8/2012 Wang ..... F41H 5/0485 428/102
8,293,353 B2 * 10/2012 Eleazer ..... B32B 5/00 428/105
8,343,614 B2 * 1/2013 Orologio ..... B32B 27/06 428/178
8,485,084 B1 * 7/2013 Cannon ..... F41H 5/0492 109/36
8,573,125 B1 * 11/2013 Rossow ..... F42D 5/05 102/303
8,584,570 B1 * 11/2013 Ogrin ..... C04B 35/053 156/245
8,590,438 B2 * 11/2013 Simovich ..... F41H 5/0414 89/36.02
8,701,540 B2 * 4/2014 Hunn ..... B22D 19/00 89/36.02
8,739,675 B2 * 6/2014 Tunis ..... F41H 5/0492 89/36.02
8,757,041 B1 * 6/2014 Gillen ..... F41H 5/045 2/2.5
8,789,454 B1 * 7/2014 Roland ..... F41H 5/04 89/36.02
8,808,602 B2 * 8/2014 Andrewartha ..... D04G 1/00 264/288.4
8,916,262 B2 * 12/2014 Hook ..... D02G 3/38 428/212
9,012,339 B2 * 4/2015 Chiou ..... A41D 31/0061 D31/61
2003/0024378 A1 * 2/2003 Ford ..... F41H 5/04 89/36.02
2008/0292854 A1 * 11/2008 Miller ..... C04B 38/0032 428/219
2009/0098405 A1 * 4/2009 Matsunami ..... B22F 1/004 428/606
2009/0271903 A1 * 11/2009 Chiou ..... B29C 70/202 2/2.5
2011/0072960 A1 * 3/2011 Hallissy ..... F41H 1/02 89/36.02
2011/0283873 A1 * 11/2011 Wadley ..... F41H 5/023 89/36.02
2012/0064329 A1 * 3/2012 Balthes ..... B29C 43/003 428/297.4
2012/0088062 A1 * 4/2012 Chiou ..... B29C 70/086 428/105
2012/0174743 A1 * 7/2012 DeGreef ..... F41H 5/02 89/36.01
2014/0123842 A1 * 5/2014 Kahmann ..... F41H 5/06 89/36.02
2014/0373707 A1 * 12/2014 Herden-Ostendorff . F41H 5/023 89/36.02

* cited by examiner

*Primary Examiner* — Michelle R Clement
(74) *Attorney, Agent, or Firm* — David S. Alavi

(57) ABSTRACT

An energy-dispersing article comprises: first and second material sheets, a first set of U-shaped rods attached at both ends to the first sheet, and a second set of U-shaped rods attached at both ends to the second sheet. The first and second material sheets are positioned in a parallel, spaced-apart arrangement with the U-shaped rods therebetween in an interleaved arrangement. Within each set of rods, the rods are of differing lengths and are arranged so that rods with attachments to one of the material sheets adjacent to a given one of the rods differ in length from that given one of the rods. The article can be arranged so as to distribute energy of a localized blast or impact on one material sheet through the rods to laterally displaced regions of that sheet. The article can be arranged as a blast shield or as armor.

14 Claims, 16 Drawing Sheets

| Material | Tensile Strength (Gpa) | Young's Modulus (Gpa) | Density kg/m³) | Characteristic Velocity $(2P/R\rho)^{1/2}$ (m/s) | Longitudinal Speed of Sound in Thin Rods (m/s) |
|---|---|---|---|---|---|
| steel | 5 | 200 | 7900 | 503-1125 | 5032 |
| aluminum alloys | 0.1-0.7 | 72 | 2700 | 272-720 | 5270 |
| titanium alloys | 0.6-1.3 | 110 | 5000 | 490-721 | 4690 |
| beryllium fiber | 3.3 | 310 | 1870 | 1879 | 12870 |
| boron fiber | 3.5 | 400 | 2450 | 1690 | 12778 |
| fused silica | | 73 | 2200 | | 5760 |
| pyrex glass | | 62 | 2320 | | 5170 |
| E-glass fiber | 2.4 | 72.4 | 2540 | 1375 | 5339 |
| S-glass fiber | 4.5 | 85.5 | 2490 | 1901 | 5860 |
| Kevlar 49 (aramid fiber) | 3.6 | 130 | 1440 | 2236 | 9502 |
| Spectra 1000 fiber (gel-spun polyethylene) | 3 | 170 | 970 | 2487 | 13239 |
| Spectra 2000 fiber (gel-spun polyethylene) | 3.51 | | 970 | 2690 | |
| PBO (plastic fiber, Zylon is brand name of PBO) | 5.8 | 280-265 | 1560-1580 | 2710-2727 | 13397-15199 |
| carbon fiber | 1-6.5 | 250-830 | 1650 | 1040-2651 | 11600-21200 |
| buckytube cable (theoretical data) | 150 | 630 | 1300 | 15191 | 22014 |

FIG. 16

ARTICLE FOR DISPERSING ENERGY OF A BLAST OR IMPACT

BACKGROUND

The field of the present invention relates to an article for dispersing blast or impact energy. In particular, a material article is disclosed that is arranged to rapidly disperse energy of a localized blast or impact to one or more regions laterally displaced from that localized blast or impact.

The technology of armor and blast shielding has remained essentially unchanged for decades. Improvement in protection provided by armor or blast shielding has typically involved simply using thicker and thicker plate material. However, the associated weight becomes unwieldy or even unusable, and the increased protection is often only marginal. A radically new approach is called for.

SUMMARY

An energy-dispersing article comprises: first and second material sheets, a first set of multiple U-shaped rods attached at both ends thereof to the first material sheet, and a second set of multiple U-shaped rods attached at both ends thereof to the second material sheet. The first and second material sheets are positioned in a substantially parallel, spaced-apart arrangement with the first and second sets of U-shaped rods therebetween in an at least partly interleaved arrangement. Within each set of rods, the rods are of differing lengths and are arranged so that one or more rods with attachments to one of the material sheets adjacent to a given one of the rods differ in length from that given one of the rods. The article can be arranged so as to distribute energy of a localized blast or impact on one material sheet through one or more of the rods to laterally displaced regions of that sheet. The article can be arranged as a blast shield or as armor.

Objects and advantages pertaining to energy-dispersing articles may become apparent upon referring to the exemplary embodiments illustrated in the drawings and disclosed in the following written description or appended claims.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIG. 16 is a table listing relevant properties of candidate materials.

Figure 1:
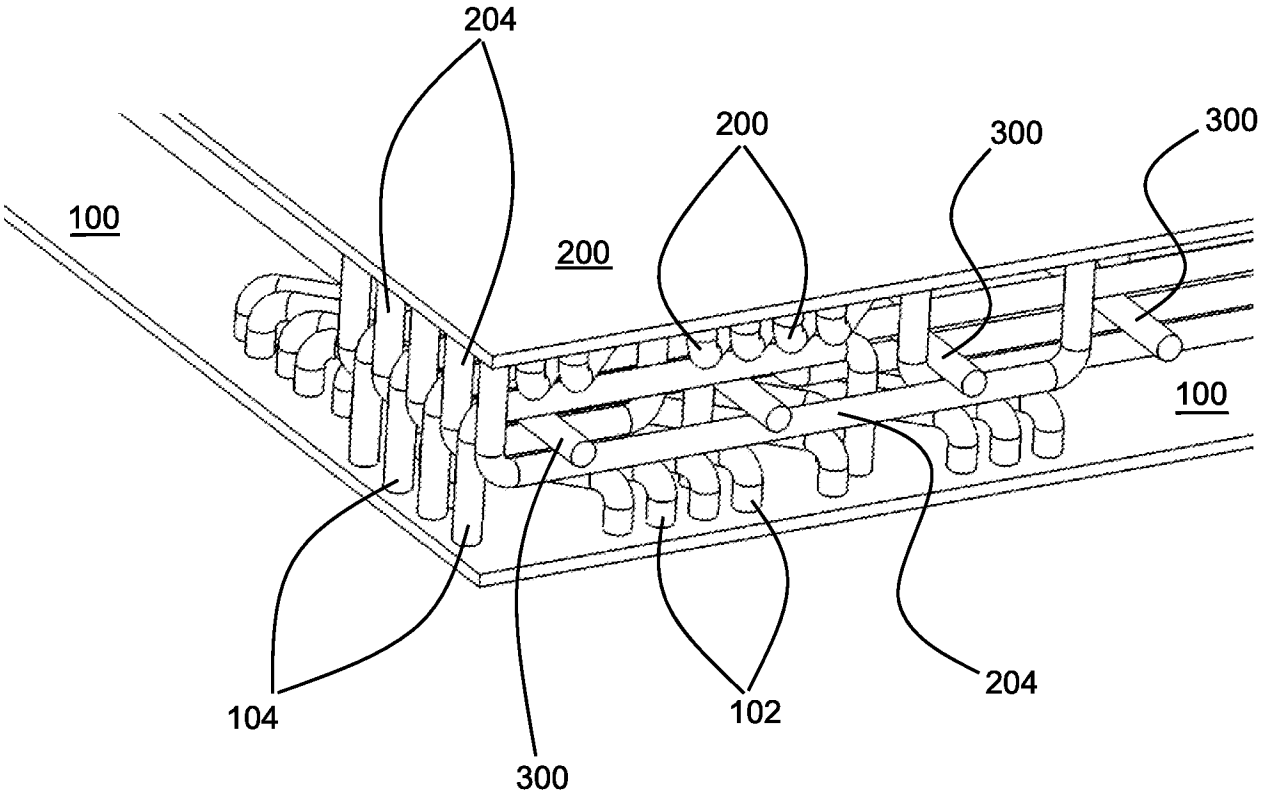
FIGS. 1 through 7 depict schematically an energy-dispersing article according to the present disclosure. The sequence of figures corresponds to a virtual "dissection" of the article, with successive structures or portions thereof removed to reveal those below.
Figure 2:
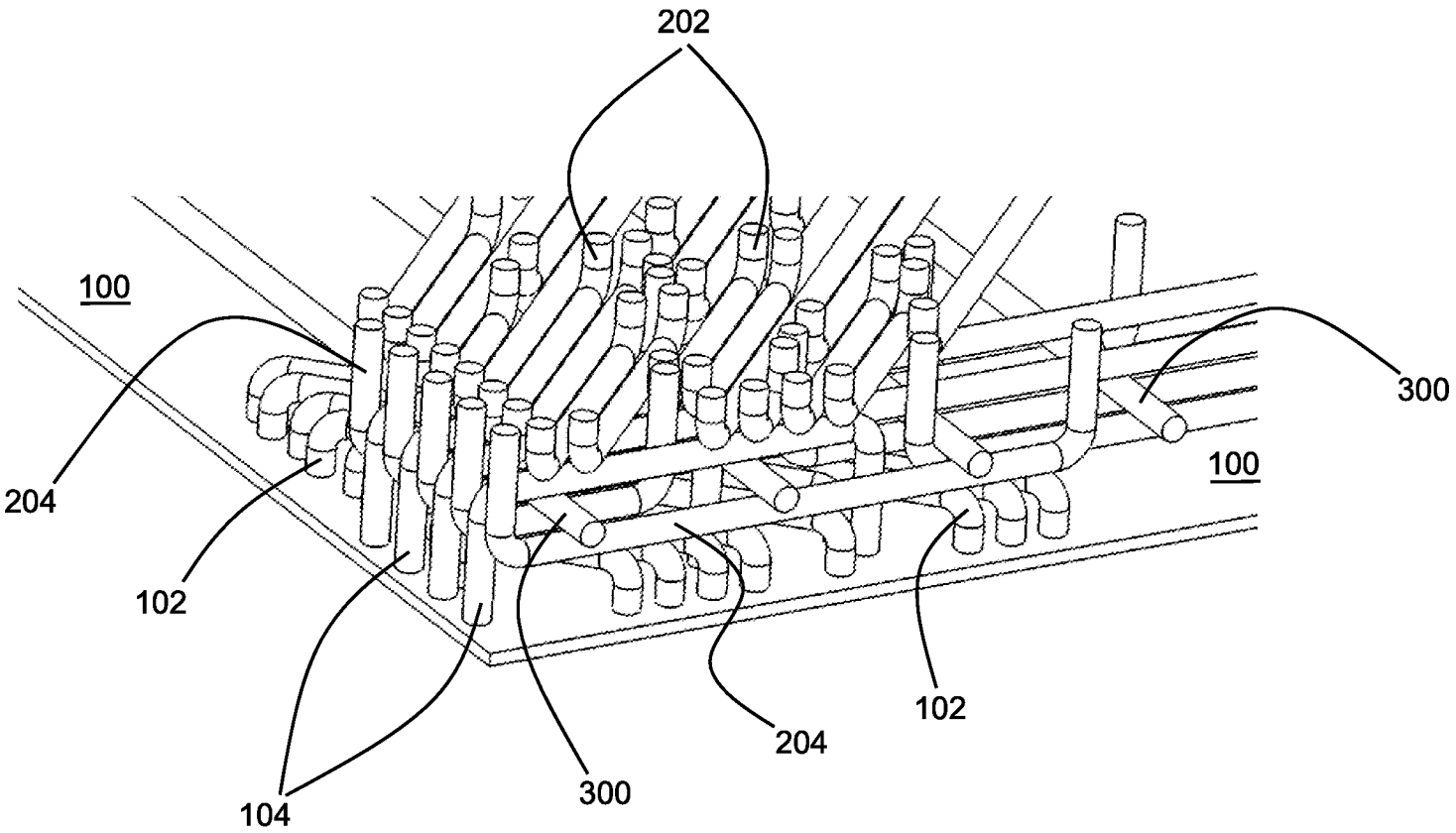
Figure 3:
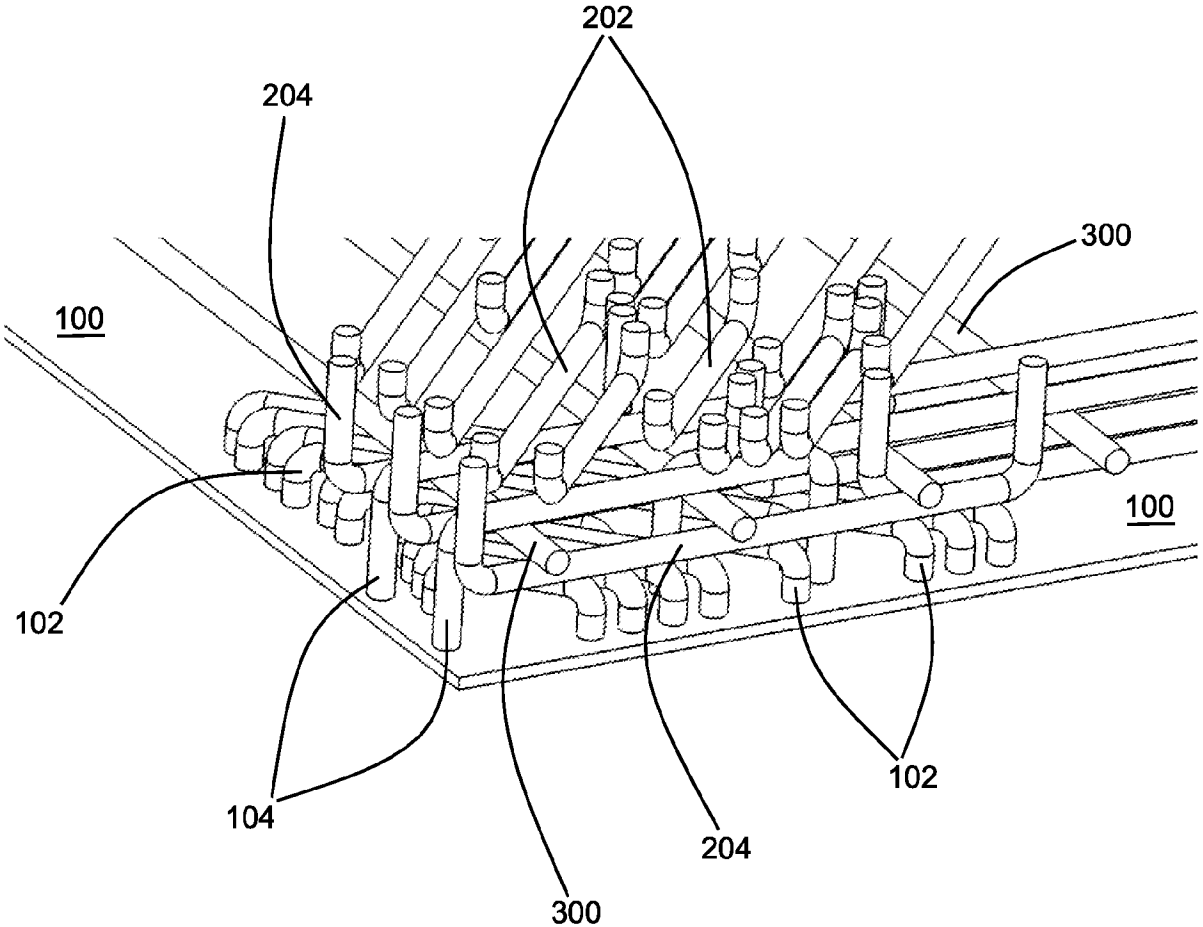
Figure 4:
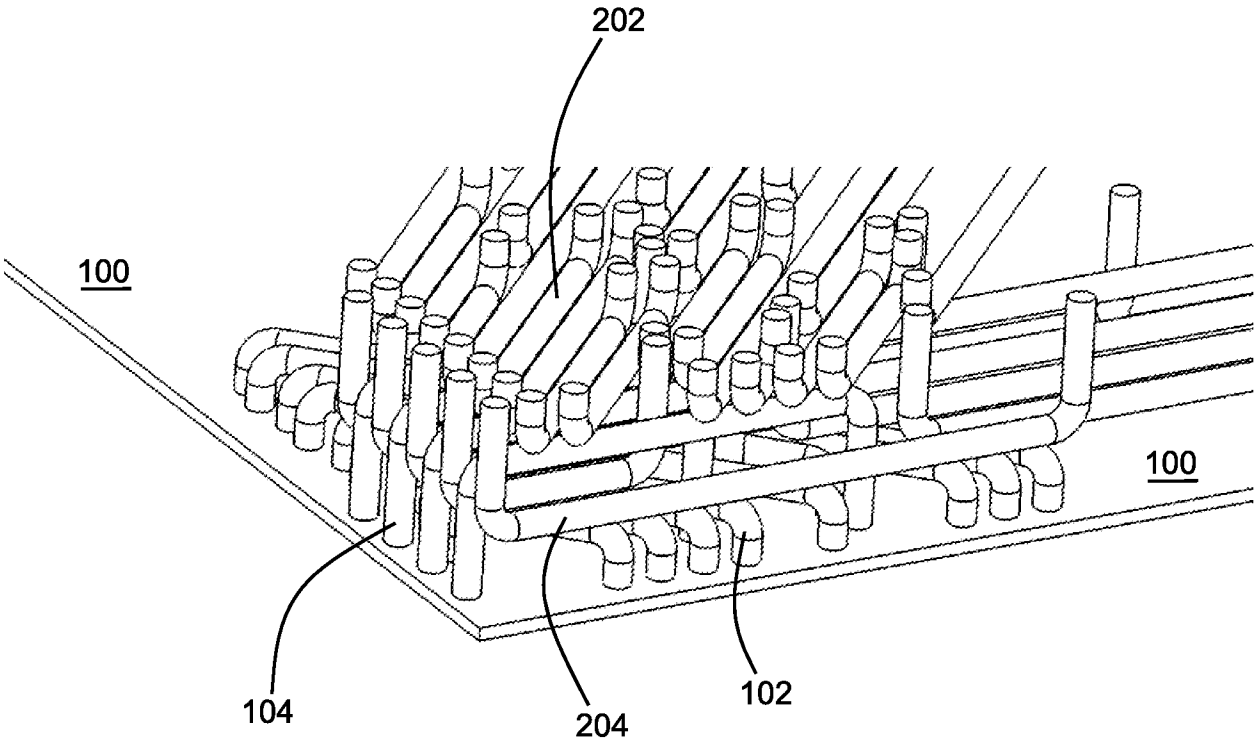
Figure 5:
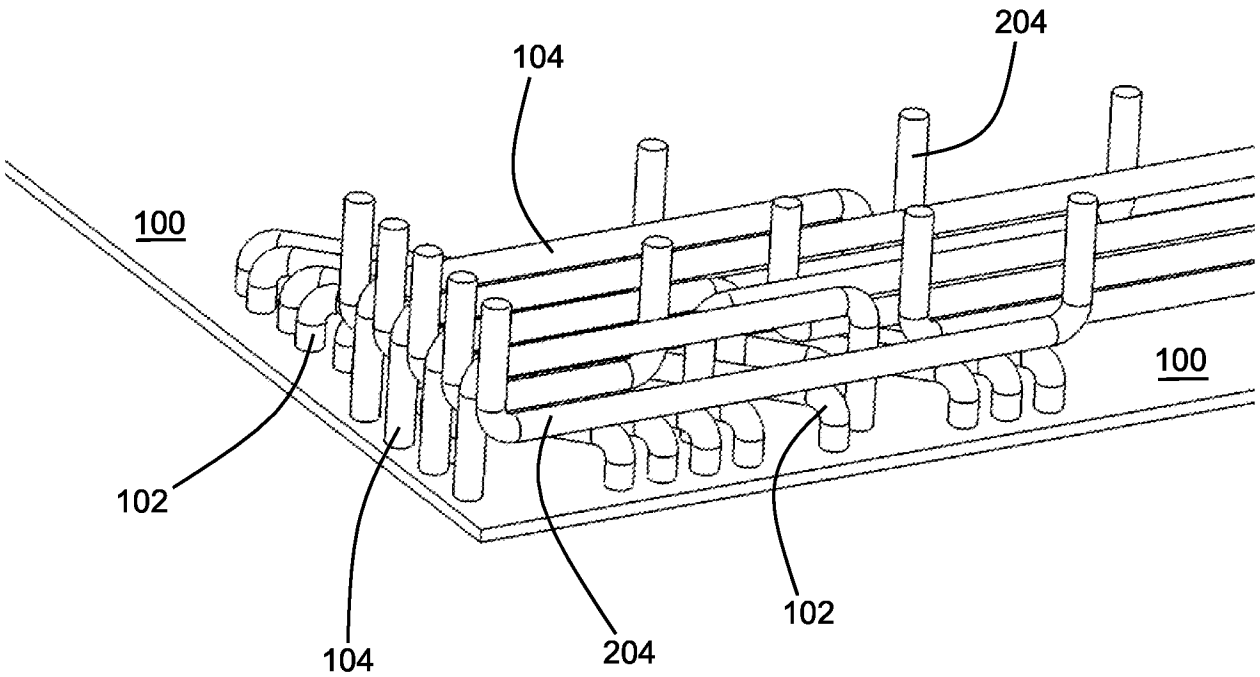
Figure 6:
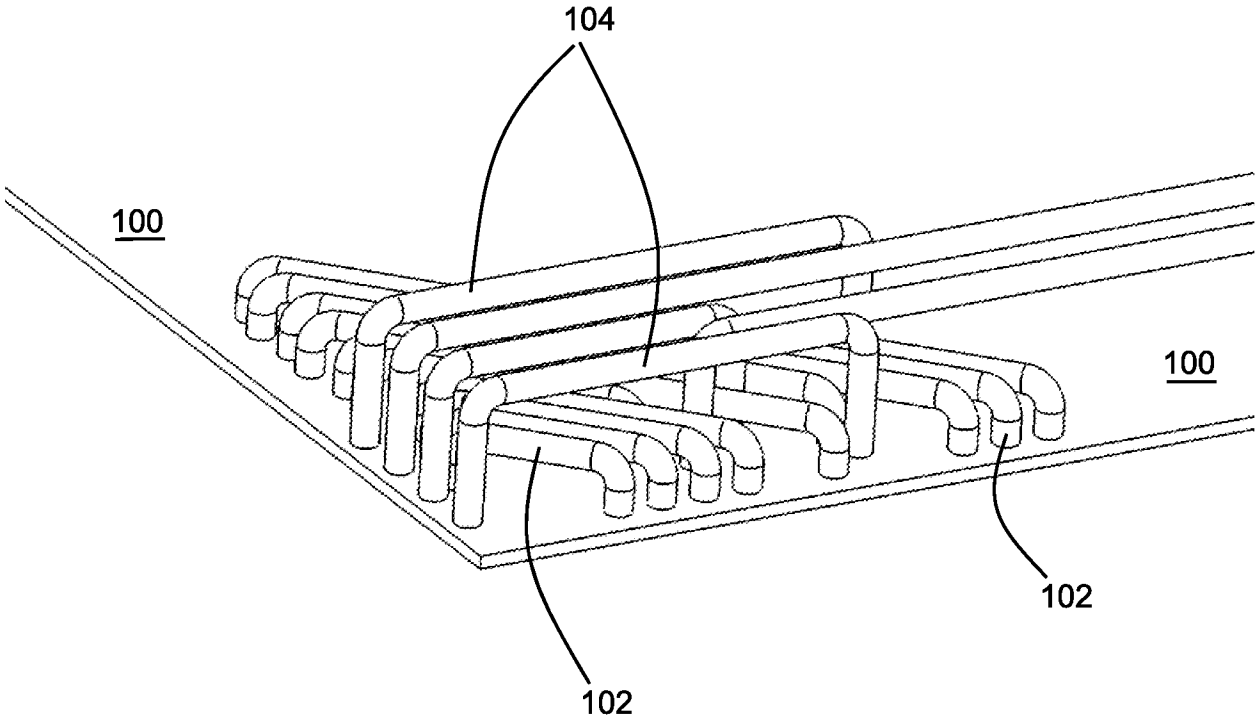
Figure 7:
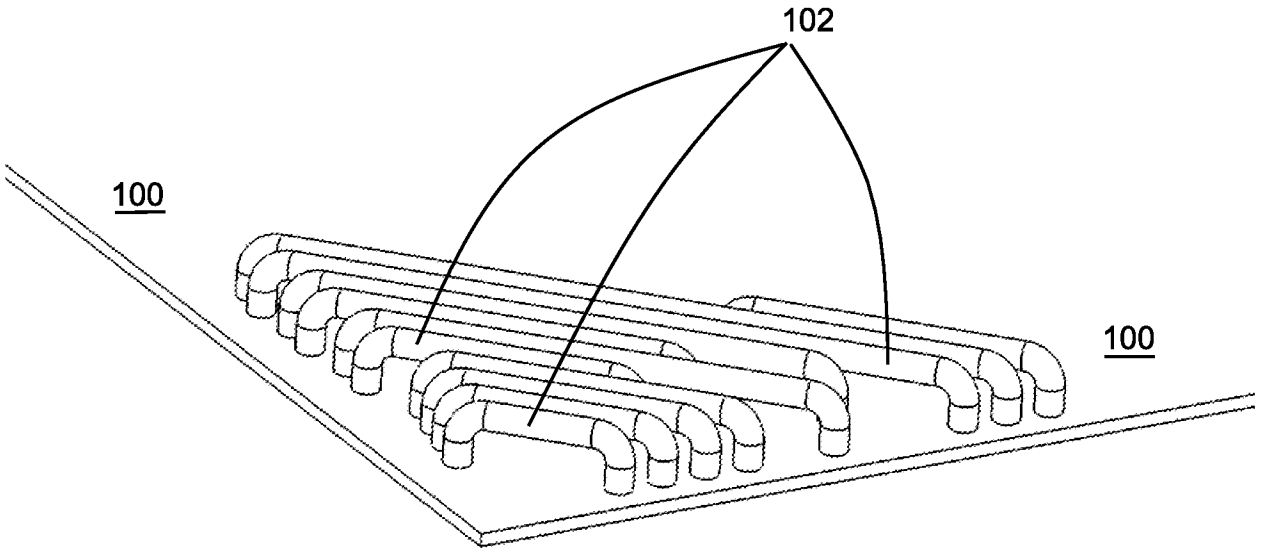
Figure 8:
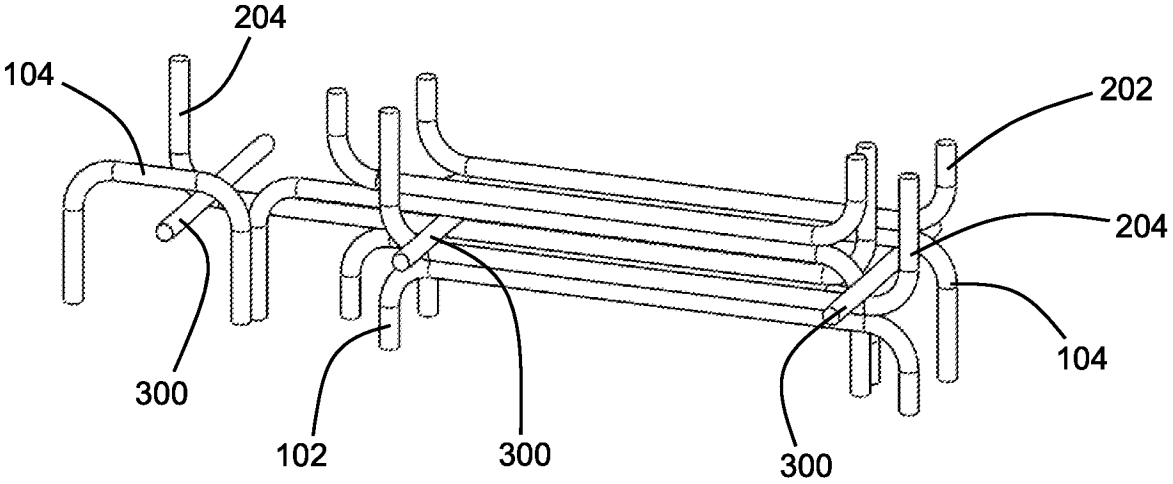
FIGS. 8 and 9 illustrate schematically U-shaped rods and tie rods of the article of FIGS. 1-7 separated from the material sheets.
Figure 9:
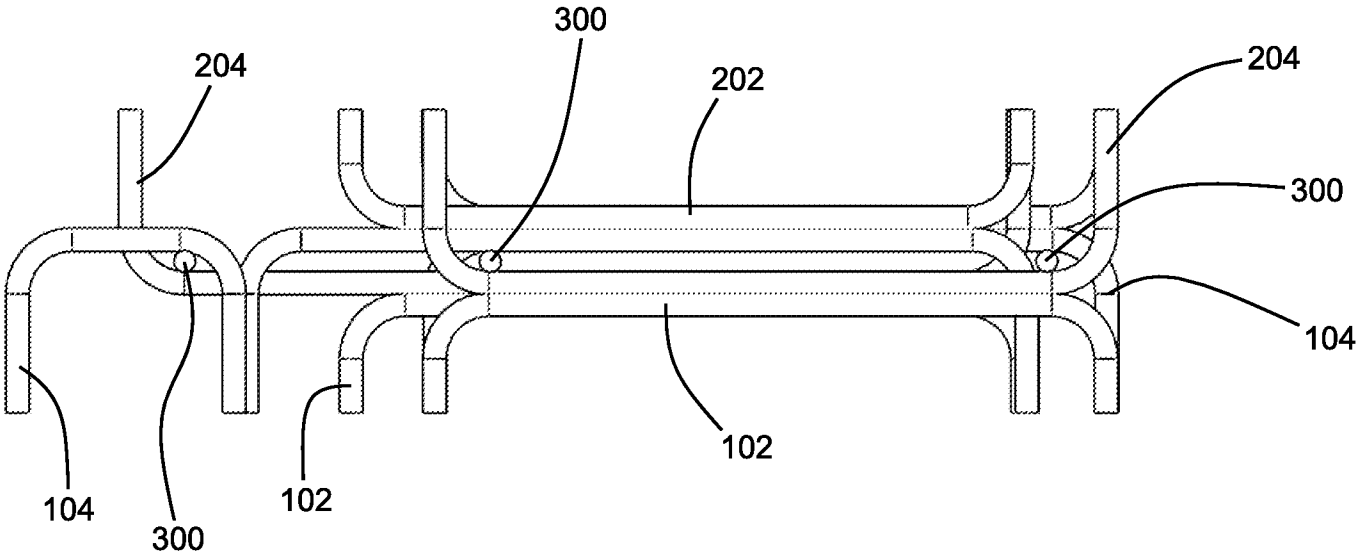

It should be noted that the embodiments depicted in this disclosure are shown only schematically, and that not all features may be shown in full detail or in proper proportion. Certain features or structures may be exaggerated relative to others for clarity. For example, the numbers and density of rods is reduced in the drawings for clarity. Terms that imply directionality, e.g., "height," "width," "horizontal," "vertical," "shorter," "taller," and so forth are defined locally relative to the first and second material sheets. The sheets are designated (locally) as "horizontal" and the direction substantially orthogonal to the sheets (locally) is designated as "vertical." No restriction on the absolute direction or orientation of the article is intended. It should be noted further that the embodiments shown are only examples, and should not be construed as limiting the scope of the written description or appended claims.

DETAILED DESCRIPTION OF EMBODIMENTS

Figure 15:
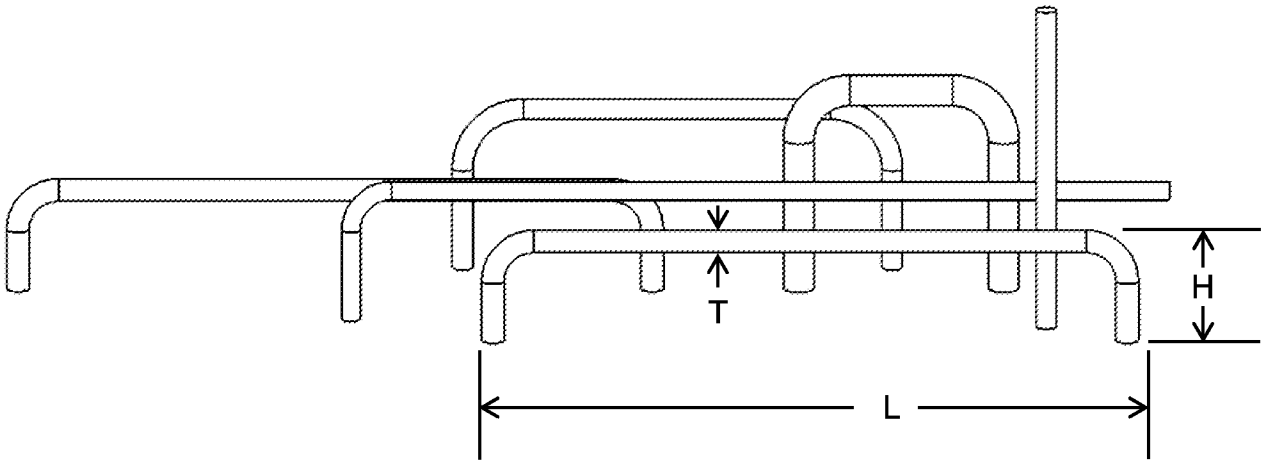
FIG. 15 illustrates schematically the dimensions L, H, and T of U-shaped rods.

An energy-dispersing article comprises a first material sheet 100, a second material sheet 200, a first set of multiple U-shaped rods 102 and 104, and a second set of multiple U-shaped rods 202 and 204 (FIGS. 1-9). Each U-shaped rod 102 and 104 of the first set is attached at both of its ends to the inner surface of the first material sheet 100; each U-shaped rod 202 and 204 of the second set is attached at both of its ends to the inner surface of the second material sheet 200. Each U-shaped rod comprises two roughly vertical end segments joined by a roughly horizontal intermediate segment. As indicated in FIG. 15, the height H of a given rod is the vertical distance between the intermediate segment of that rod and the material sheet to which it is attached, the length L is the horizontal distance between the two vertical segments of the given rod, and the thickness T is the width of a transverse cross-section of the given rod.

The first and second material sheets 100 and 200 are positioned in a substantially parallel, spaced-apart arrangement with the respective inner surfaces facing one another. The material sheets 100 and 200 can be substantially flat or they can be curved; the substantially parallel, spaced-apart arrangement of the two sheets is defined locally for curved sheets. The first and second sets of U-shaped rods 102, 104, 202, and 204 are positioned between the first and second material sheets 100 and 200. The two sets of rods are positioned in an at least partly interleaved arrangement.

The rods 102, 104, 202, and 204 are of differing lengths. Each rod is arranged so that one or more other rods with adjacent attachments to the same material sheet are of differing lengths. There may, however, also be rods of the same length, both adjacent as well as elsewhere. Each one of the rods of the first and second sets is arranged to transmit acoustomechanical energy along its respective length at a velocity greater than a velocity of acoustomechanical energy transmission between the first and second material sheets 100 and 200. In this way, the article is arranged so as to distribute energy of a localized blast or impact on an outer surface of the first or second material sheet through one or more of the rods of the first or second sets to one or more laterally displaced regions of the first or second material sheets. The differing length of the rods results in dispersal of the impact or blast energy over a larger area, thereby reducing the likelihood of penetration or failure of the material sheets 100 and 200 and reducing the fraction of the energy that propagates forward through the material sheets 100 and 200 and across the space between them. Once confined to the rods, the acoustomechanical energy tends to remain localized within them and propagate along their length, in a manner roughly analogous to light propagation in an optical waveguide. The energy-dispersing article therefore can function as armor or as a blast shield. In additional to its energy dispersal behavior, the network of rods between the two material sheets can also induce tumbling of a penetrating projectile, reducing the likelihood of penetration by that projectile.

In some embodiments, each of the rods 102, 104, 202, and 204 of the first and second sets can be between about 0.1 inches and about 0.3 inches in thickness. The shortest rods typically can be about 3 inches long, while the longest rods typically can be about 24 inches long. A distribution of intermediate rod lengths typically are employed (e.g., rods lengths of about 3, 6, 9, . . . , and 24 inches can be employed). Separation between the material sheets can be about 3 to 4 inches in some embodiments; there must be adequate separation of the two material sheets to accommodate the arrangement of the rods between them. Depending on materials employed, expected impact or blast energies, expected projectile size, type, or velocity, size or weight constraints, or the size of an area to be shielded, other suitable thicknesses, lengths, or separations can be employed.

In one embodiment, the rods of each set are arranged to have one of two differing heights. In the example shown in the drawings, all those rods on one of the sheets that are of the taller height are arranged substantially parallel to one another on that sheet, and are not parallel to one or more of those rods of the shorter height that are attached to the same sheet. The other sheet and its rods are similarly arranged. The two material sheets 100 and 200 and their attached rods 102, 104, 202, and 204 are assembled with the rods between the two material sheets. When thus assembled, the intermediate portions of one or more of the shorter rods 102 attached to the first material sheet 100 rest against the intermediate portions of one or more of the taller rods 204 attached to the second material sheet 200. Similarly, the intermediate portions of one or more of the shorter rods 202 attached to the second material sheet 200 rest against the intermediate portions of one or more of the taller rods 104 attached to the first material sheet 100. The taller rods 104 and 204 are arranged on their respective material sheets are arranged so that, upon assembly, one or more of the taller rods 104 and one or more of the taller rods 204 are interleaved with one another. The substantially parallel arrangement of the taller rods 104 and 204 shown in the drawings facilitates such interleaving, but is not required. Any arrangement of the taller rods 104 and 204 can be employed that permits them to assume an at least partly interleaved arrangement, with each set of taller rods 104 and 204 in contact with the corresponding set of shorter rods 202 and 102, respectively.

The rods can have circular, elliptical, oval, polygonal, or other cross-sectional shape. It is desirable that the cross-sectional shape result in only tangential or otherwise minimal contact between rods (e.g., where taller rods of one sheet rest against shorter rods of the other sheet) in order to reduce flow of energy from one rod to another. Such impediment of energy flow ensures that blast or impact energy entering certain rods through one material sheet is dispersed by propagation along only those rods without substantial leakage to the other material sheet. In the symmetric embodiments shown in the drawings (i.e., two material sheets with similar arrangements of rods attached to each), the rods attached to the material sheet facing the blast or impact serve mainly to convey energy laterally away from the blast or impact zone, while the rods attached to the other material sheet serve primarily to reduce leakage of that propagating energy into the other sheet.

A set of multiple tie rods 300 can be employed to hold the two material sheets 100 and 200 together with the rods 102, 104, 202, and 204 between them. Each tie rod 300 is positioned between and substantially parallel to the first and second material sheets 100 and 200. Each tie rod 300 passes between one or more of the first set of rods (the taller rods 104) and the first material sheet 100, i.e., through the loop formed by the attachment of the U-shaped rod 104 to the first material sheet 100. Similarly, each tie rod 300 also passes between one or more of the second set of rods (the taller rods 204) and the second material sheet 200, i.e., through the loop formed by the attachment of the U-shaped rod 204 to the second material sheet 200. By passing through such loops attached to both material sheets 100 and 200, the tie rods 300 holds the sheets together. The tie rods 300 can comprise the same material as the rods 102, 104, 202, and 204, or can comprise different material, provided the material employed is sufficiently strong or stiff to maintain structural integrity of the assembled sheets 100 and 200.

Materials can be chosen for the rods that result in relatively large sound velocity along the lengths of the rods, thereby facilitating rapid lateral dispersal of such blast or impact energy. Solid metal rods can be employed; stiffer fibrous or composite material can be preferable owing to their typically higher sound velocities. Examples of materials of varying suitability are given in the table of FIG. 16.

If solid metal rods are employed, the vertical segments of each rod can be arranged with a conical, pyramidal, or other tapered shape to facilitate entry of impact or blast energy (i.e., energy impinging on one of the material sheets with a significant component normal to that sheet) into the rod to propagate along the rod. The base shape of such tapered segments can be arranged to fill a greater fraction of the area of the corresponding material sheet to direct a correspondingly greater fraction of the blast or impact energy into the rods.

Figure 10:
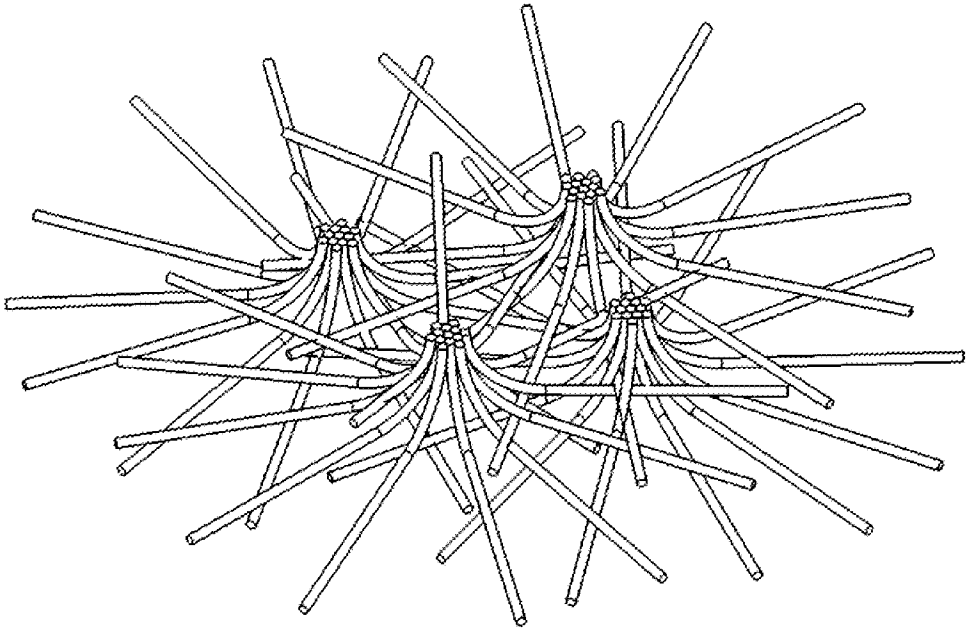
FIG. 10 illustrates schematically fibers extending from the ends of several rods and spread laterally for binding to a material sheet.
Figure 11:
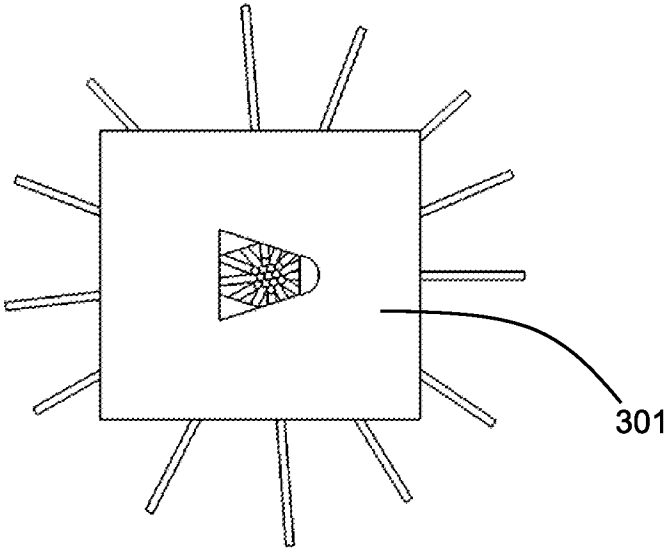
FIGS. 11-14 illustrate schematically a process for arranging fibers extending from the end of a rod to be bound to a material sheet.

In some embodiments, each rod 102, 104, 202, or 204 of the first and second sets comprises a corresponding bundle of fibers arranged substantially longitudinally along that rod. The fibers can comprise braided or twisted metal fibers, polymer fibers and a suitable binder material (e.g., a resinous binder), or glass, carbon, or mineral fibers and a suitable binder material (e.g., a resinous binder). In such embodiments, it can be advantageous for each one of the first and second material sheets 100 and 200 to include a sheet of woven or matted fibers and a suitable binder material (e.g., a resinous binder). The woven or matted fibers and binder can make up the entire material sheet, or can comprise one layer of a multilayer material sheet. In some examples (e.g., FIG. 10), fibers extending from the ends of the one or more rods 102, 104, 202, or 204 of the first or second set can be woven into or matted onto the fibers of the corresponding first or second material sheet 100 or 200. In some examples, fibers extending from the ends of the one or more rods of the first or second sets can comprise the fibers of the corresponding first or second material sheet.

Figure 12:
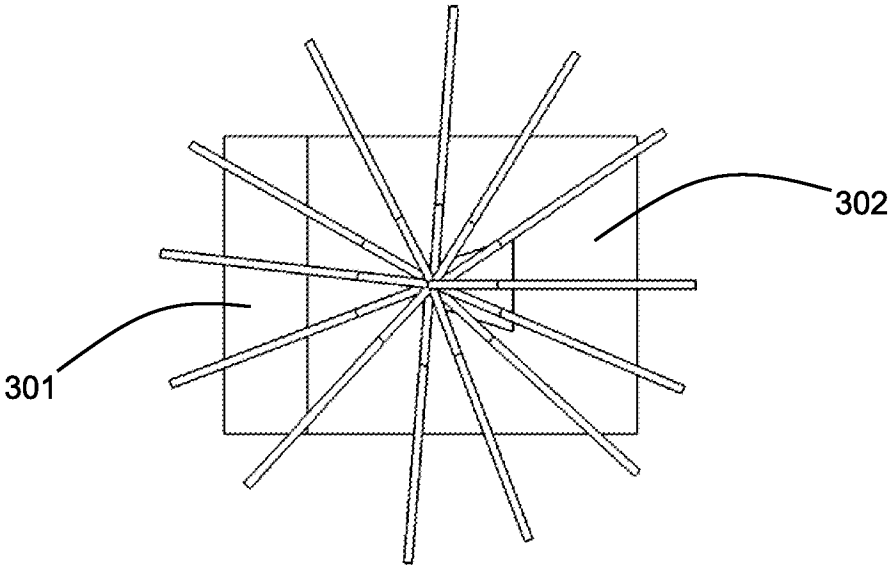
Figure 13:
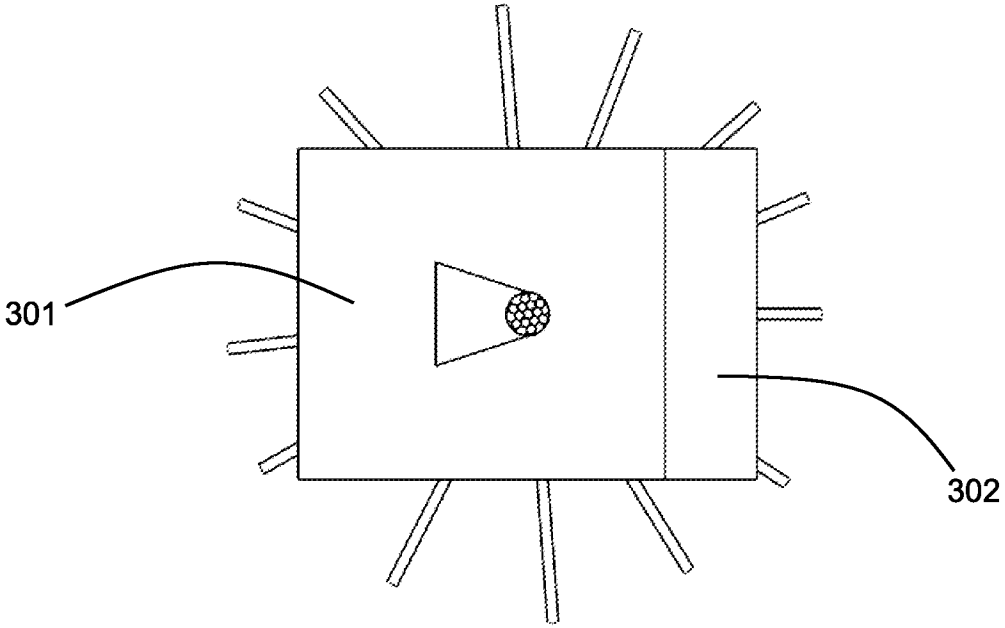
Figure 14:
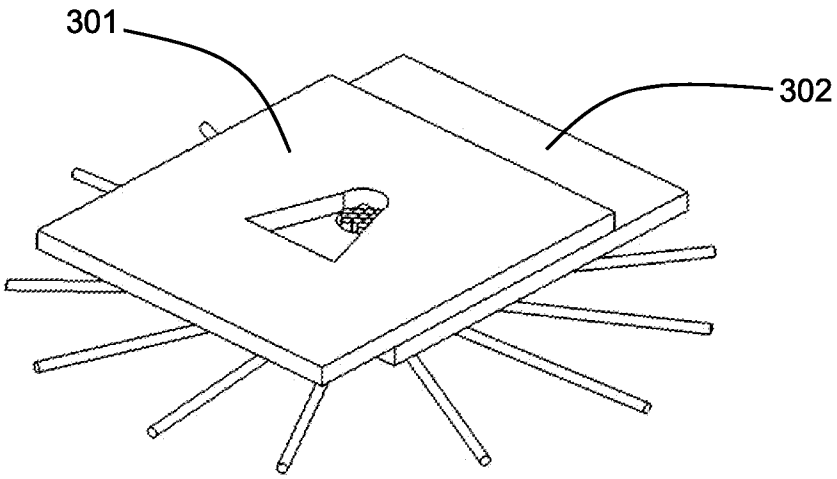

The energy-dispersing article can be fabricated in any suitable way, including hand assembly. One example is depicted in FIGS. 11-14, in which the rods comprise bundled fibers that are matted onto or woven into the corresponding material sheet. A pair of plates 301 and 302 are employed on which are located corresponding aligned, wedge shaped apertures. With the plates 301 and 302 positioned against one another, they are moved to align the wider portions of the apertures (FIG. 11), yielding a hole through both plates large enough to readily insert fibers extending from the ends of the rods through the apertures. Sliding the plates so that only the narrower portions of the apertures are aligned reduces the size of the apertures to constrain the rods and extended fibers to localized positions (FIGS. 12-14). The fibers are spread laterally from the apertures (FIGS. 12-14) by any suitable method, e.g., by direct manipulation, by blowing air or gas, or by gravity. The spread fibers can be woven or matted together with each other, or woven or matted into an additional woven or matted fibrous sheet. A suitable binder (e.g., a resinous binder) can be employed to bind the fibers together (with or without the additional fibrous sheet). The bound fibers can remain adhered to the plates 301 and 302, or those plates can be removed (e.g., by dissolution in a suitable solvent, or by cutting away). If desired, the bound fibers can be adhered to an additional material sheet layer. Such an additional material sheet layer can comprise any suitable or desired material, e.g., such as polymer, composite, metal, and so forth. Such an additional material sheet layer can be adhered to the fibers in the same process employed to bind the fibers, or can be adhered in a separate process after the fibers are bound together.

In addition to the preceding, the following examples fall within the scope of the present disclosure or appended claims:

Example 1

An article comprising: (a) a first material sheet having an outer surface and an inner surface; (b) a first set of multiple U-shaped rods, each of which is attached at both ends thereof to the inner surface of the first material sheet and has a corresponding height of its end segments, length of its intermediate segment, and thickness; (c) a second first material sheet having an outer surface and an inner surface; and (d) a second set of multiple U-shaped rods, each of which is attached at both ends thereof to the inner surface of the second material sheet and has a corresponding height of its end segments, length of its intermediate segment, and thickness, wherein: (e) the first and second material sheets are positioned in a substantially parallel, spaced-apart arrangement with the respective inner surfaces facing one another and with the first and second sets of U-shaped rods therebetween in an at least partly interleaved arrangement; (f) the rods of the first set are of differing lengths and are arranged so that one or more rods with attachments to the first material sheet adjacent to a given one of the rods differ in length from that given one of the rods; and (g) the rods of the second set are of differing lengths and are arranged so that one or more of those rods with attachments to the second material sheet adjacent to a given one of the rods differ in length from that given one of the rods.

Example 2

The article of Example 1 wherein: (h) the rods of the first set are of two differing taller and shorter heights and the rods of the second set are of the two differing taller and shorter heights; (i) the intermediate portions of one or more of the shorter rods attached to the first material sheet rest against the intermediate portions of one or more of the taller rods attached to the second material sheet; (j) the intermediate portions of one or more of the shorter rods attached to the second material sheet rest against the intermediate portions of one or more of the taller rods attached to the first material sheet; and (k) one or more of the taller rods attached to the first material sheet and one or more of the taller rods attached to the second material sheet are interleaved with one another.

Example 3

The article of Example 2 further comprising a set of multiple tie rods wherein: (l) each tie rod is positioned between and substantially parallel to the first and second material sheets; (m) each tie rod passes between one or more of the first set of rods and the first material sheet; and (n) each tie rod passes between one or more of the second set of rods and the second material sheet.

Example 4

The article of any preceding Example wherein each rod of the first and second sets comprises a corresponding bundle of fibers arranged substantially longitudinally along that rod.

Example 5

The article of Example 4 wherein the fibers comprise braided or twisted metal fibers.

Example 6

The article of Example 4 wherein the fibers comprise polymer fibers and a binder material.

Example 7

The article of Example 4 wherein the fibers comprise glass, carbon, or mineral fibers and a binder material.

Example 8

The article of any one of Examples 4-7 wherein each one of the first and second material sheets comprises a sheet of woven or matted fibers and a binder material.

Example 9

The article of Example 8 wherein fibers extending from the ends of the one or more rods of the first or second sets comprise, are woven into, or are matted onto the woven or matted fibers of the corresponding first or second material sheet.

Example 10

The article of any preceding Example wherein: (h) each of the rods of the first and second sets is between about 0.1 inches and about 0.3 inches in thickness; and (i) each of the rods of the first and second sets is greater than or about equal to 3 inches long.

Example 11

The article of any preceding Example wherein one or more of the rods of the first and second sets is greater than or about equal to 24 inches cm long.

Example 12

The article of any preceding Example wherein each one of the rods of the first and second sets is arranged to transmit acoustomechanical energy along its respective length at a velocity greater than a velocity of acoustomechanical energy transmission between the first and second material sheets.

Example 13

The article of any preceding Example wherein the article is arranged so as to distribute energy of a localized blast or impact on an outer surface of the first or second material sheet through one or more of the rods of the first or second sets to one or more laterally displaced regions of the first or second material sheets.

Example 14

The article of any preceding Example wherein the article is arranged as a blast shield or as armor.

The disclosed embodiments and methods are only examples. It is intended that equivalents of the disclosed embodiments and methods shall fall within the scope of the present disclosure or appended claims. It is intended that the disclosed embodiments and methods, and equivalents thereof, may be modified while remaining within the scope of the present disclosure or appended claims.

In the foregoing Detailed Description, various features may be grouped together in several exemplary embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed exemplary embodiment. Thus, the appended claims are hereby incorporated into the Detailed Description, with each claim standing on its own as a separate disclosed embodiment. However, the present disclosure shall also be construed as implicitly disclosing any embodiment having any suitable set of one or more disclosed or claimed features (i.e., sets of features that are not incompatible or mutually exclusive) that appear in the present disclosure or the appended claims, including those sets that may not be explicitly disclosed herein. It should be further noted that the scope of the appended claims do not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising," "including," "having," and variants thereof, wherever they appear, shall be construed as open ended terminology, with the same meaning as if the phrase "at least" were appended after each instance thereof.

In the appended claims, if the provisions of 35 USC §112 ¶6 are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112 ¶6 are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. An article comprising:

(a) a first material sheet having an outer surface and an inner surface;

(b) a first set of multiple U-shaped rods, each of which is attached at both ends thereof to the inner surface of the first material sheet and has a corresponding height of its end segments, length of its intermediate segment, and thickness;

(c) a second first material sheet having an outer surface and an inner surface; and (d) a second set of multiple U-shaped rods, each of which is attached at both ends thereof to the inner surface of the second material sheet and has a corresponding height of its end segments, length of its intermediate segment, and thickness, wherein:

(e) the first and second material sheets are positioned in a substantially parallel, spaced-apart arrangement with the respective inner surfaces facing one another and with the first and second sets of U-shaped rods therebetween in an at least partly interleaved arrangement;

(f) the rods of the first set are of differing lengths and are arranged so that one or more rods with attachments to the first material sheet adjacent to a given one of the rods differ in length from that given one of the rods; and (g) the rods of the second set are of differing lengths and are arranged so that one or more of those rods with attachments to the second material sheet adjacent to a given one of the rods differ in length from that given one of the rods.

2. The article of claim 1 wherein:

(h) the rods of the first set are of two differing taller and shorter heights and the rods of the second set are of the two differing taller and shorter heights;

(i) the intermediate portions of one or more of the shorter rods attached to the first material sheet rest against the intermediate portions of one or more of the taller rods attached to the second material sheet;

(j) the intermediate portions of one or more of the shorter rods attached to the second material sheet rest against the intermediate portions of one or more of the taller rods attached to the first material sheet; and (k) one or more of the taller rods attached to the first material sheet and one or more of the taller rods attached to the second material sheet are interleaved with one another.

3. The article of claim 2 further comprising a set of multiple tie rods wherein:

(l) each tie rod is positioned between and substantially parallel to the first and second material sheets;

(m) each tie rod passes between one or more of the first set of rods and the first material sheet; and (n) each tie rod passes between one or more of the second set of rods and the second material sheet.

4. The article of claim 1 wherein each rod of the first and second sets comprises a corresponding bundle of fibers arranged substantially longitudinally along that rod.

5. The article of claim 4 wherein the fibers comprise braided or twisted metal fibers.

6. The article of claim 4 wherein the fibers comprise polymer fibers and a binder material.

7. The article of claim 4 wherein the fibers comprise glass, carbon, or mineral fibers and a binder material.

8. The article of claim 4 wherein each one of the first and second material sheets comprises a sheet of woven or matted fibers and a binder material.

9. The article of claim 8 wherein fibers extending from the ends of the one or more rods of the first or second sets comprise, are woven into, or are matted onto the woven or matted fibers of the corresponding first or second material sheet.

10. The article of claim 1 wherein:

(h) each of the rods of the first and second sets is between about 0.1 inches and about 0.3 inches in thickness; and (i) each of the rods of the first and second sets is greater than or about equal to 3 inches long.

11. The article of claim 10 wherein one or more of the rods of the first and second sets is greater than or about equal to 24 inches cm long.

12. The article of claim 1 wherein each one of the rods of the first and second sets is arranged to transmit acoustomechanical energy along its respective length at a velocity greater than a velocity of acoustomechanical energy transmission between the first and second material sheets.

13. The article of claim 12 wherein the article is arranged so as to distribute energy of a localized blast or impact on an outer surface of the first or second material sheet through one or more of the rods of the first or second sets to one or more laterally displaced regions of the first or second material sheets.

14. The article of claim 13 wherein the article is arranged as a blast shield or as armor.

* * * * *